United States Patent [19]

Hook

[11] 4,363,735

[45] Dec. 14, 1982

[54] REMOVAL OF FLY ASH FROM THE SURFACE OF LIQUIDS

[76] Inventor: Derek L. Hook, 6 Maltmans Rd., Lymm, Cheshire, England

[21] Appl. No.: 258,997

[22] Filed: Apr. 30, 1981

[30] Foreign Application Priority Data

Dec. 6, 1980 [GB] United Kingdom ..... 8039204

[51] Int. Cl.[3] ..... B01D 21/00

[52] U.S. Cl. ..... 210/776; 106/DIG. 1; 210/747; 210/242.1; 405/60

[58] Field of Search ..... 210/776, 242.1, 242.3, 210/170, 153, 161, 162, 747; 405/60, 64, 52, 53, 74; 106/DIG. 1

[56] References Cited

U.S. PATENT DOCUMENTS

| | | | |
|---|---|---|---|
| 3,268,081 | 8/1966 | Menkee et al. | 210/242.1 |
| 3,859,799 | 1/1975 | Jaco, Jr. | 106/DIG. 1 |
| 4,313,762 | 2/1982 | Pound | 106/DIG. 1 |

FOREIGN PATENT DOCUMENTS

| | | | |
|---|---|---|---|
| 1439953 | 6/1976 | United Kingdom | 210/242.1 |
| 1441006 | 6/1976 | United Kingdom | 210/242.1 |
| 1553461 | 9/1979 | United Kingdom | 210/242.1 |

OTHER PUBLICATIONS

Reed, G. A. et al., "Water Quality Effects of Fly Ash Disposal", 31st Purdue University Ind. Waste Conference, pp. 337-343, (1976).

Nemerow, N. L., "Industrial Water Pollution, Origins, Characteristics, and Treatment", Addison-Wesley Pub. Co., pp. 626-627, (1978).

*Primary Examiner*—Benoit Castel

*Attorney, Agent, or Firm*—William R. Hinds

[57] ABSTRACT

A method of removing a part of a stratum of fly ash comprising particles of relatively fine mean dimensions from the surface of a pond comprising submerging the leading edge of a scoop having a grid structure below the layer of fly ash, driving the scoop forwardly so that ash enters the scoop, lifting the scoop above the pond so that it drains of liquid and then tipping the drained ash from the scoop to a suitable location.

7 Claims, 7 Drawing Figures

10-16
13
10
42
11
12
14
41
40
38
39
35a
37
8
35
36
34
-31-
33
32
-30-
9

34
-31-
13
10
11
38

REMOVAL OF FLY ASH FROM THE SURFACE OF LIQUIDS

This invention relates to the removal of fly ash from the surfaces of liquids and is concerned particularly with the removal of floating fly ash from settling ponds of electricity generating stations fired by pulverised coal.

Fly ash in a pond settles in two strata: the majority forming a stratum at the base of the pond and a minority forming a plurality submerged stratum at the surface of the pond. There is a need to remove the surface stratum as it can form an irregular surface and parts of it can dry out and be dispersed, objectionably, by wind. Additionally, the fly ash has commercial use and its recovery is justified.

Accordingly, it is an object of the invention to provide a method of removing fly ash from the surface of a liquid.

It is a further object of the invention to provide a method in which the removed fly ash is drained of liquid and deposited away from the liquid.

It is a further object to provide an effective method of removing the drained ash to a land vehicle.

According to one aspect of the present invention a method of removing a part of a stratum of fly ash from the surface of a liquid comprises:

(a) at least partly submerging a plurality of laterally spaced elongate lifting elements below the stratum;
(b) lifting the elements through the stratum so that at least a part of the fly ash is raised above the stratum on the elements;
(c) allowing the raised ash to drain by liquid flow through the spaces between the elements; and
(d) tilting the elements to discharge the drained ash to a location away from the liquid.

One suitable location may be staging at the edge of the liquid. Another suitable location may be a self-draining boat. This boat may itself carry a mechanism for manipulating the elements. The boat could operate in the manner of a belt dredger with dredger buckets replaced by frames carrying the elements. This would provide a sequence of scoops disposed so the elements in each scoop are arranged parallel to each other and extend from the leading edge to the trailing edge of the respective scoop, said scoop being sequentially moved through the stratum. However, for general use mobility may be important and, in this event, the elements are supported by a framework so that they can form a readily transportable unit, such as a scoop, of which, the elements are a part and are arranged parallel from the leading edge to the trailing edge of the scoop.

The spaces between the elements are very much larger than the mean dimensions of the particles of powder being raised. Typically the space dimension may be 1.0 to 2.0 cms and the particle (spherical) dimension may be 20 to 200 microns. The elements may take the form of strips or bars.

The elements may have flat upper surfaces and typically have a width from half to twice the spacing between them. The thickness of the elements is typically approximately 1 mm to 5 mm. The material of the elements is preferably selected so as to be non-corrosive with the medium or powder with which they operate so that a smooth surface can be easily maintained on the elements and so as to have a lack of affinity with the powder being lifted so that, on tilting the elements, the powder readily slides away from them. With fly ash removal from ponds, stainless steel strips would be preferred.

Moistened fly ash (as existing as a surface stratum on a pond) appears to exhibit the property of very little flowing movement between its particles and hence, when lifted by a series of flat strip surfaces (such as the upper surfaces of spaced bars) it stacks up despite the fact that there is a significant space available between the bars through which it might escape. The significant space does, however, allow for rapid drainage of the raised ash.

Also according to the present invention there is provided an operational structure, for removing a part of a stratum of fly ash from the surface of a liquid, comprising:

(a) a grid structure of spaced parallel elements each exposing a smooth upper surface;
(b) a frame structure having a leading edge and a trailing edge, said frame structure supporting the grid structure so that said elements run substantially parallel to each other and at right angles to said edges; and
(c) means on the frame structure whereby it may be connected to a raising and tilting mechanism.

The frame structure may have buoyancy chambers.

The elements may be curved or bent along their length so that they together define a scoop-like structure of a base and a back rising from the base. The frame structure would be similarly shaped to match the curvature or bends of the elements.

The grid structure may be mounted on a floating structure which is self-propelled which has a hydraulic system to permit level adjustment, raising, lowering, and tilting of the grid structure.

A possible variant to the grid structure above described may be to provide a structure of strips or elements with inclined side walls, such as strips of trapezoidal section. In fact the strips might be provided as the webs of a sheet having a structure like that of expanded metal. Alternatively full circular-section, semi-circular section, triangular section, or oval-section bars could be used. Lightness, with adequate strength, is one criterion.

As mentioned above, the raised powders may be discharged into a self-draining boat. To remove the discharged powders from the boat, or from any other location, to a land vehicle it is proposed, also in accordance with the invention, to use a known form of grab, such as a sugar beet or other tine grab, modified to have an internal lining of spaced, smooth parallel strips to reduce adhesion between the powders and the grab. Alternatively the grab may be in the form of a slotted box.

A preferred form of the invention will now be described further with reference to the accompanying drawings in which.

Figure 1:
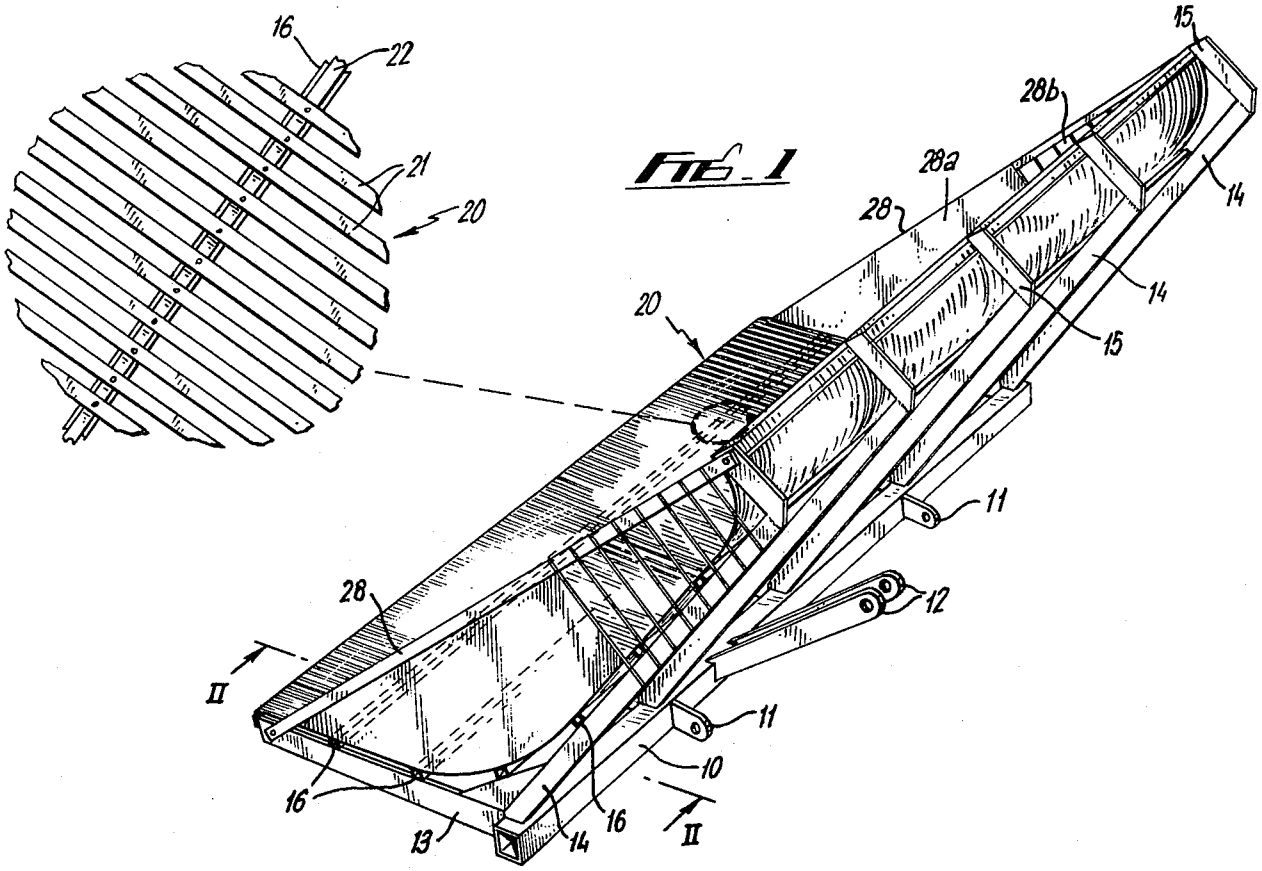
FIG. 1 is a perspective view of a scoop-like structure according to the invention with associated pivot lugs and tilting bar.
Figure 2B:
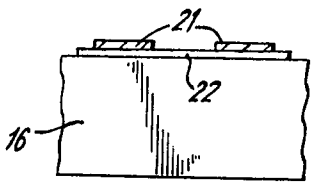
FIG. 2B is a fragmentary further enlarged view on the line B—B of FIG. 2A.
Figure 2C:
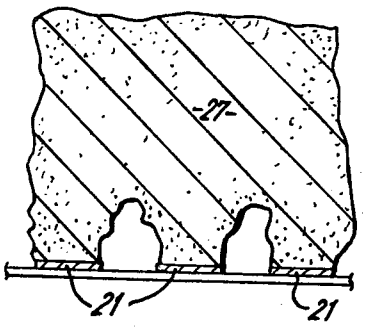
FIG. 2C is a fragmentary view showing the build-up of fly ash on the grid of the structure of FIGS. 1 and 2.
Figure 2:
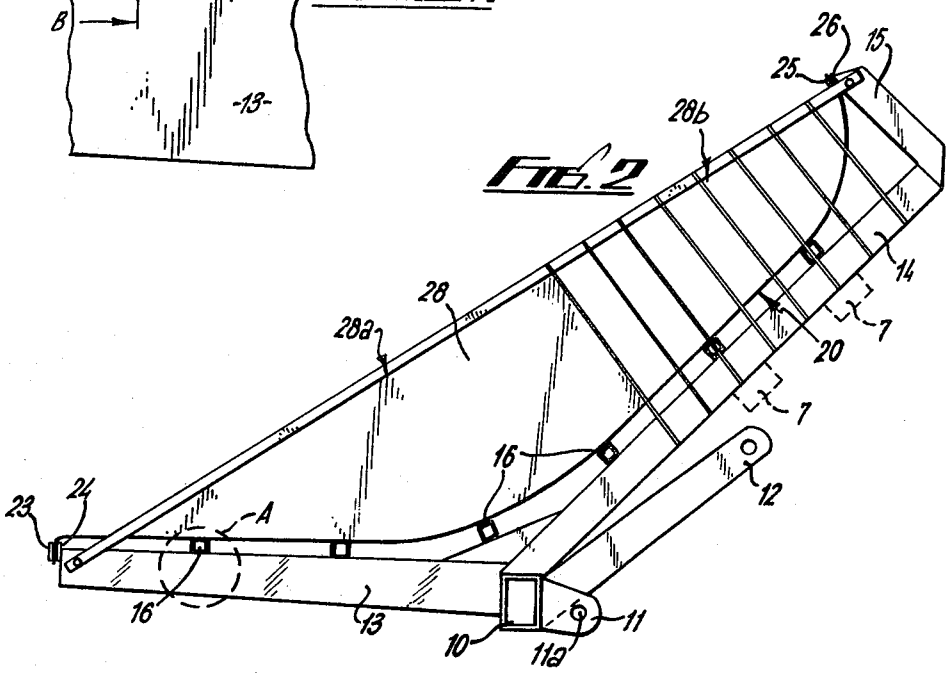
FIG. 2 is a sectional elevation on the line II—II of FIG. 1.

In FIGS. 1 and 2 there is shown a rectangular section longitudinal hollow base member 10. This member has two pivot stubs 11 having pivot holes 11*a* and two pivot arms 12 welded to it. The base member 10 also has welded to it five tapered (as seen in the elevation of FIG. 2), equally spaced, nominally horizontal "seat" bars 13 and five equally spaced nominally upwardly and rearwardly inclined "back" bars 14. The bars 14 respectively terminate at capping bars 15. Six rectangular section longitudinal hollow stringers 16 extend parallel to the base member 10, and are welded to bars 13 or 14. The parts 10 to 16 above referred to can be regarded as forming a scoop-like framework suitable for pivoting on an axis passing through the holes 11*a* on the stubs 11. Once fabricated, the framework (which is of mild steel) is hot-dipped galvanised.

Figure 2A:
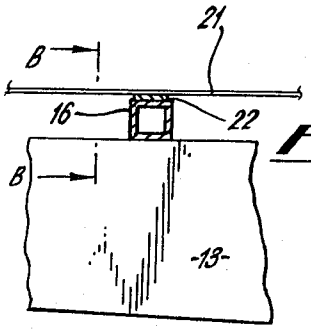
FIG. 2A is a fragmentary enlarged view of the area A in FIG. 2.

The framework has attached to it and supports a stainless steel grid 20. This grid is made from No. 18 gauge (about 1 mm thick) strip material 10 mm wide. Strips 21 of the grid run in the direction from the front (leading edge) to the rear (trailing edge) of the framework and at right angles to these edges. The curved or bent substantially parallel strips 21 are laterally spaced apart by an amount slightly greater than the width of the strips, namely 12.5 mm. Typically, there are eighty strips 21 distributed over the side to side dimension of the framework each having a flat upper surface. Strips 22 of the grid 20 run at right angles to the strips 21. There are eight of these strips 22 and they are spot welded to the strips 21 where the strips 21 and 22 cross each other and they serve to keep the strips 21 correctly spaced. (The strips 21, 22 are not shown in detail on FIG. 2 as the scale is not suitable but they are presented in FIGS. 2A and 2B). The grid 20 is held in place on the scoop-like framework by clamping bars 23, 24 along the front of the framework and clamping bars 25, 26 at the top back of the framework.

Both ends of the framework have side wall defining plates 28 each having a forward solid part 28*a* and a rearward open or perforated part 28*b*.

FIG. 2C shows a section of fly ash 27 stacked up on a fragment of the bars 21.

Figures 3, 3A:
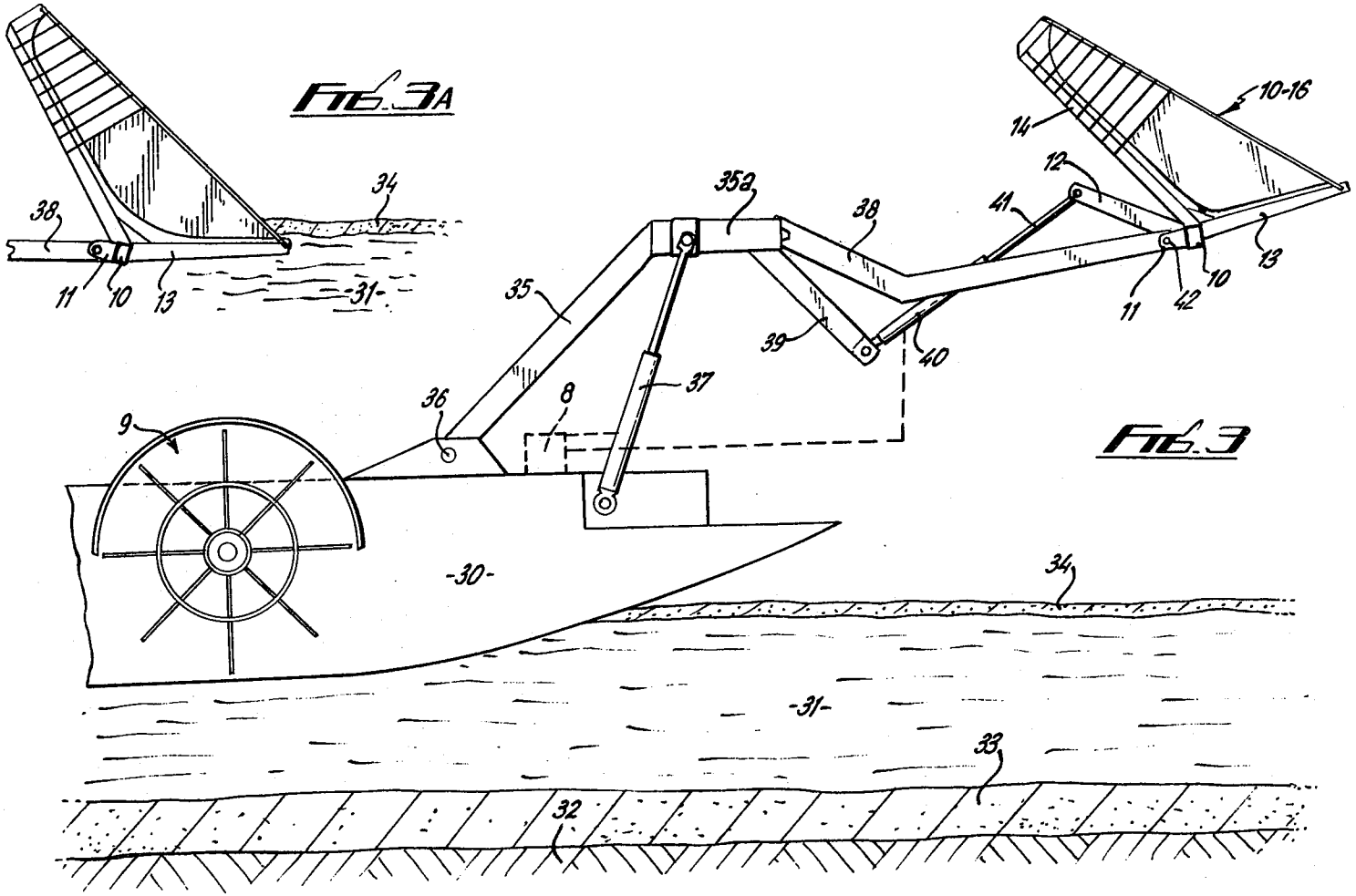
FIG. 3 is a diagram representing in side view the structure of FIG. 1 mounted on a boat.
FIG. 3A shows the invention in use.

In FIG. 3 a flat-bottom, shallow draught self-draining boat 30 is shown in a pond 31 (illustrated in section). The pond has a base 32 which is covered with a layer 33 of fly ash which has sunk through the pond and a surface layer or stratum 34 of fly ash. The boat may for example be propelled by side paddle wheels 9.

The boat carries a pair of laterally spaced arms 35 respectively pivoted at pins 36 and operable to pivot under control of a hydraulic cylinder 37 itself controlled as indicated dotted by conventional pump and control mechanism 8 mounted on the boat. Between the arms 35 there is a cross member 35*a* to which is joined a pair of spaced cranked arms 38 and a reaction strut 39 which supports a hydraulic cylinder 40 controlled in conventional manner from mechanism 8. The piston rod 41 of the cylinder is joined between the pair of pivot arms 12 (see FIGS. 1 and 2). The framework 10 to 16 is carried at the outboard ends of the arms 38 at pivot pins 42 engaging the pivot stubs 11 of the framework. The hydraulic structure 8, 37, 40, 41, enables the level adjustment, raising, lowering, and tilting of the grid structure.

In use (FIG. 3A) the scoop-like structure having the grid 20 is lowered into the pond so that the seat bars 13 lie below and parallel to the layer 34 of fly ash. The boat 30 is then driven forward at a slow steady rate of about 1 knot. A band in the layer of fly ash is thus taken from the surface of the pond 31 and the majority of this band of ash is retained on the grid 20 in the manner shown in FIG. 2C whilst a minority passes between the strips 21 of the grid. After a short while the gaps between the strips 21 are bridged and a bed of porous wet fly ash exists on the grid. The highly polished nature of the grid and the high mutual affinity the particles of fly ash have for each other allows the bed of ash to move rearwardly on the grid as more ash is taken on the front of the grid. This rearward movement can be aided by progressively tipping the grid anti-clockwise (as seen in FIG. 3A) by cylinder 40 whilst keeping the leading edge below the layer 34 of ash by lowering of arms 38 through cylinder 37. When a load of ash has been gathered the grid with its load of ash can be lifted and drained above the pond and the boat reversed towards staging at the edge of the pond onto which the drained load can be discharged by tipping the grid forwards. Again the smooth nature of the grid allows the load to be easily discharged.

The apertured part 28*b* of the end plates 28 aids drainage of water from ash on the grid whilst the solid part 28*a* helps retain a packed and full bed of ash.

The lifting elements 21 could be wholly submerged beneath the layer 34 during at least part of forward movement of the boat.

The drained load could be discharged into the boat.

The framework 10 to 16 may be provided with buoyancy chambers indicated diagrammatically at 7 (FIG. 2).

I claim:

1. A method of removing a part of a stratum of fly ash comprising particles of relatively fine mean dimensions from the surface of a liquid comprising:

(a) at least partly submerging a scoop having a plurality of laterally spaced elongate lifting elements below the stratum the spacing between the lifting elements being very much larger than the mean dimensions of the particles;

(b) lifting the elements through the stratum so that at least a part of the fly ash is raised above the stratum on the elements;

(c) allowing the raised ash to drain by liquid flow through the spaces between the elements; and (d) tilting the elements to discharge the drained ash to a location away from the liquid.

2. A method as claimed in claim 1, in which said location is a self-draining boat.

3. A method as claimed in claim 1, in which the elements are arranged parallel from the leading edge to the trailing edge of the scoop and the scoop is driven forwardly after the leading edge has been submerged below said stratum.

4. A method as claimed in claim 1, in which the elements are provided by a sequence of scoops disposed so the elements in each scoop are arranged parallel to each other and extend from the leading edge to the trailing edge of the respective scoop, said scoops being sequentially moved through the stratum.

5. A method as claimed in claim 1, in which each of said elements has a flat upper surface.

6. A method as claimed in claim 1, in which the width of the elements is less than the spacing between the elements.

7. A method according to claim 1, in which the discharged fly ash is removed to a land vehicle by a grab having an internal lining of spaced smooth parallel strips to reduce adhesion between the ash and the grab.

* * * * *